United States Patent [19]

Baker

[11] 3,942,836

[45] Mar. 9, 1976

[54] CHAIR

[75] Inventor: Richard H. Baker, Grand Rapids, Mich.

[73] Assignee: Steelcase Inc., Grand Rapids, Mich.

[22] Filed: Apr. 22, 1974

[21] Appl. No.: 463,131

[52] U.S. Cl. ..... 297/445; 297/452; 297/457

[51] Int. Cl.[2] ..... A47C 1/12

[58] Field of Search ..... 297/445, 452, 457, 214, 297/204, 195, 282, 308, 307

[56] References Cited

UNITED STATES PATENTS

| | | | |
|---|---|---|---|
| 946,225 | 1/1910 | Irwin | 297/457 X |
| 1,641,330 | 9/1927 | Headley | 297/452 X |
| 1,836,353 | 12/1931 | Withrow | 297/308 X |
| 3,111,344 | 11/1963 | Hoven et al. | 297/452 |
| 3,120,407 | 2/1964 | Propst | 297/457 |
| 3,471,200 | 10/1969 | Morrison | 297/457 X |
| 3,601,176 | 8/1971 | Savickas | 297/445 |
| 3,675,970 | 7/1972 | Bereday | 297/452 |

FOREIGN PATENTS OR APPLICATIONS

| | | | |
|---|---|---|---|
| 661,993 | 4/1963 | Canada | 297/445 |
| 1,190,445 | 10/1959 | France | 297/214 |

*Primary Examiner*—James T. McCall
*Assistant Examiner*—Peter A. Aschenbrenner
*Attorney, Agent, or Firm*—Price, Heneveld, Huizenga & Cooper

[57] ABSTRACT

The specification discloses a chair having a seat seated on spaced side rails above an auxiliary seat supporting surface which is spaced slightly below the seat and which shares the load imposed on the seat by a person sitting in it with the side rails and their supporting stretcher, yet allows the seat to give slightly so that the seat feels comfortably yielding.

9 Claims, 13 Drawing Figures

CHAIR

BACKGROUND OF THE INVENTION

The present invention relates to office furniture chairs.

Prior art sling type office chairs employ a pair of spaced side rails to which is fastened some type of supporting fabric. The fabric is somehow securely clamped to the side rails so as to provide a sling between the side rails. The fabric of course gives slightly when seated upon to give the chair a comfortable feeling. However, sling chairs are relatively expensive in the office furniture industry, probably primarily because of the expensive fastening systems required to properly secure the slung upholstery to the side rails.

Stacking chairs employ a generally rigid seat member mounted on some type of frame. Generally, the seat spans some distance between spaced frame members at the side of the frame. Because the seat is somewhat rigid, the problem of fastening the sides of the seat to the side support members of the frame is less critical than the problem of fastening slung upholstery to the side rails of a sling chair. Still, there is a severe loading situation when the seat is sat upon and accordingly, substantial fastening is required to properly secure the seat member to the spaced side members of the frame. One prior art U.S. Pat. No. 3,431,022 to Poppe et al discloses the employment of support shoes positioned immediately adjacent the chair side rails to aid in supporting the rigid seat member when seated upon. The edges of the seat member are also securely clamped to the side members. Another prior art patent to Faiks and Buhk, U.S. Pat. No. 3,724,897 discloses a stacking chair in which a tongue and slot arrangement are employed at the sides of a relatively rigid seat to aid in holding the seat member securely to the sides of the chair frame.

As is apparent, a good deal of expense is involved in securing either the sling type upholstery to its supporting side rails or the more rigid seat member to the side supporting members of its supporting frame. There has been a need for improving the strength of such chairs in an economical way as is evident by the above mentioned patent and development activity in the area of improving the securing systems at the sides of sling type and stacking type chairs.

SUMMARY OF THE INVENTION

The present invention involves a radical departure from prior art lines of development relative to improving securement of the side edges of the seat member to the spaced side rails or frame members of the chair. The chair of the present invention employs a pair of spaced side rails joined to the arms of a stretcher and a rigid supporting seat seated on the side rails and spanning the space there between, the seat having only sufficient flexibility to flex slightly when a person using the chair sits on it. Rather than attempting to strengthen the juncture of the rigid seat member to the spaced side rails, I have taken advantage of the fact that the seat does flex to create a chair with a comfortable, yielding give when it is seated upon. To provide sufficient supporting strength for the chair, I employ a seat supporting surface positioned below the seat and generally above the support column of the seat base. A slight space is provided between the supporting seat and the seat support surface whereby the seat flexes downwardly slightly when a person sits on it and comes to rest on the seat support surface such that the seat support surface transmits a portion of the load imposed on the seat directly downwardly to the supporting column, thereby decreasing the load which has to be carried by the chair side rails and the struts of the supporting stretcher.

These and other objects, features and advantages of the present invention will be more fully understood and appreciated by reference to the written specification and appended drawings.

DESCRIPTION OF THE PREFERRED EMBODIMENT

Figure 1:
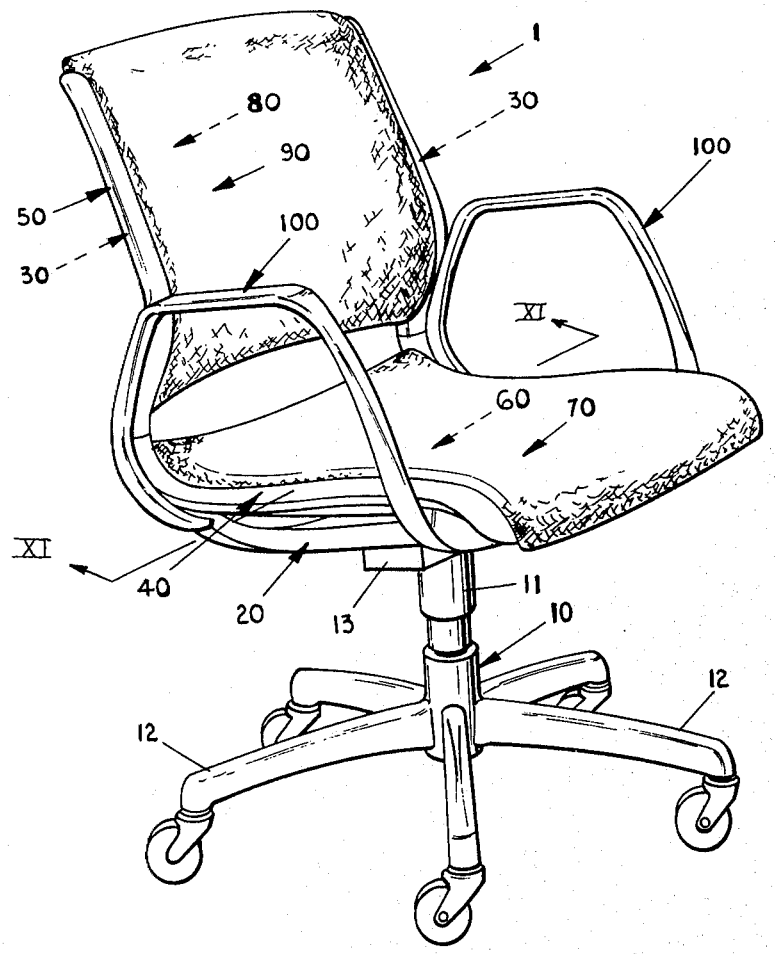
FIG. 1 is a perspective view of the chair of the present invention.
Figure 2:
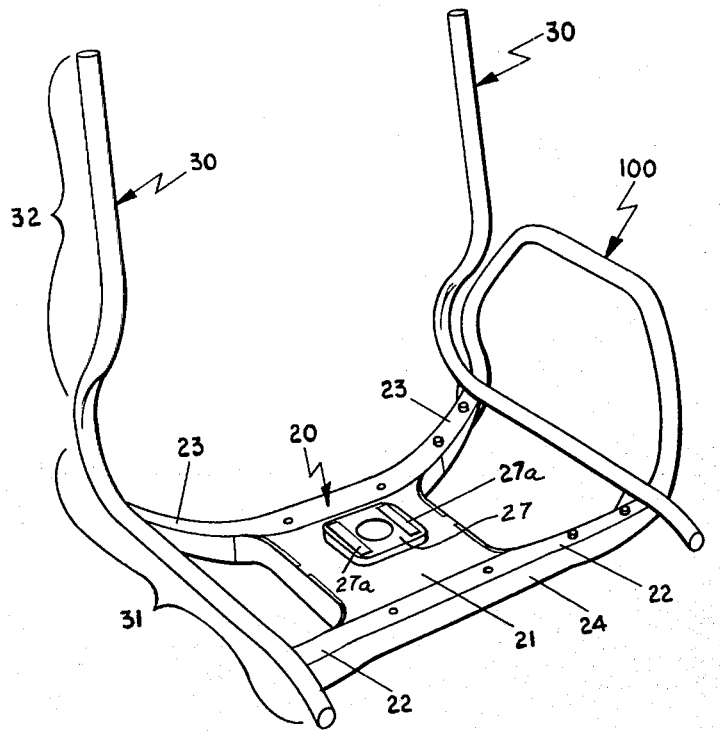
FIG. 2 is a perspective view of the stretcher and side rails of the chair.

The chair 1 of the present invention comprises a stretcher 20 operably mounted on a base 10 for supporting at its ends a pair of spaced side rails (FIGS. 1 and 2). Secured to side rails 30 are a formed plastic supporting seat 40 and a formed plastic supporting back 50 (FIGS. 1 and 4) each having at its side edges side channels 41 and 51 respectively which are seated over side rails 30 (FIGS. 3, 4, 5, 6, 7, and 8). Stretcher 20 includes an upwardly protruding dome 27 whose top defines a seat supporting surface, spaced slightly below seat 40 to allow it to give slightly when sat upon and to provide a surface for seat 40 to come to rest upon so that a portion of the load imposed upon the chair is transmitted generally directly downwardly to the support column 11 of base 10.

Figure 13:
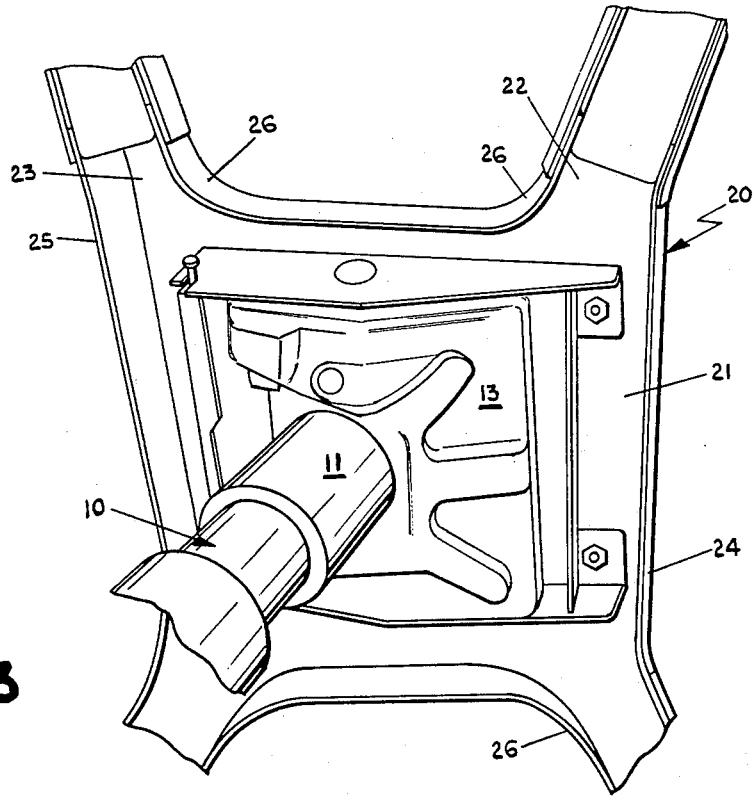
FIG. 13 is a bottom, fragmentary view showing the central portion of the stretcher with the upper portion of the base attached thereto.

Base 10 is a pedestal type of base having a support column 11 with a plurality of legs 12 projecting outwardly from generally the bottom thereof and with a chair tilter control 13 or other mounting mechanism positioned generally at the top of post or support column 11 (FIGS. 1 and 13). Stretcher 20 includes an enlarged, generally square shaped central mounting pan 21 to which control 13 is fastened by bolts or like fasteners.

Figure 3:
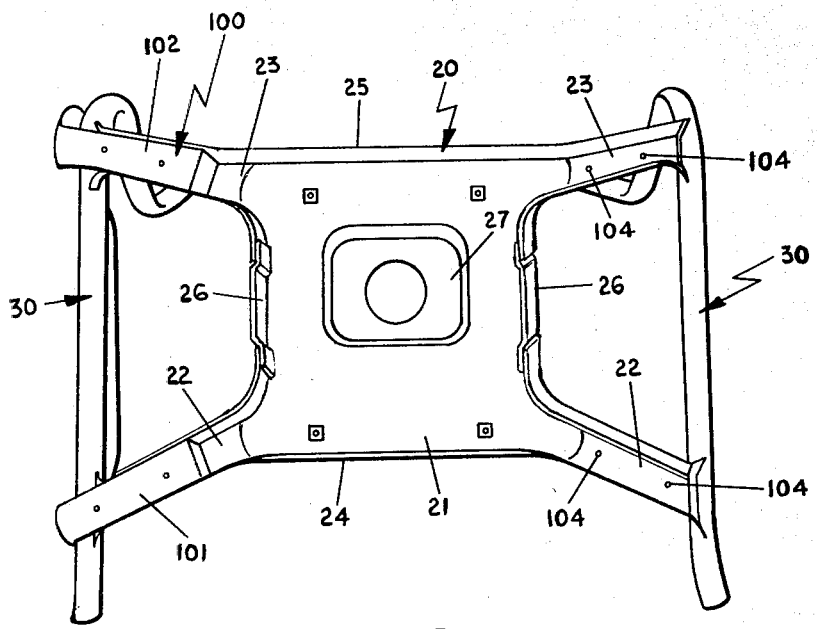
FIG. 3 is a bottom plan view of the stretcher and side rails with one arm attached.

Stretcher 20 is formed of stamped steel. Projecting outwardly from each side of central mounting pan 21 are a front strut 22 and a rear strut 23 (FIGS. 2, 3 and 13). Bent over along the front of stretcher 20 is a front wall 24 which extends downwardly across the front edge of mounting pan 21 and across the leading edge of both front struts 22. Projecting downwardly from the rear edge of stretcher 20 is a rear wall 25 which extends along the rear edge of mounting pan 21 and along the rear edges of rear struts 23. In a similar fashion, a side wall 26 extends downwardly and runs along the side edges of mounting pan 21 and bends outwardly and extends outwardly along the inside edges of front and rear struts 22 and 23 which face each other. All of these downwardly depending walls 24, 25, 26 help to hide from view the control 13 of base 10 and its securement to stretcher 20. Also, the downwardly depending walls give added strength to stretcher 20. Finally, in extending along struts 22 and 23, these walls give the struts a generally downwardly opening channel shaped configuration which facilitates the mounting of arms 100 to the struts 22 and 23 of stretcher 20. Preferably, the front channels 22 and front wall 24 are formed as one piece, the rear channels 23 and rear wall 25 are formed as one piece and mounting pan 21 is formed as one piece. These three pieces are then welded together to form an integral stretcher 20.

Figure 11:
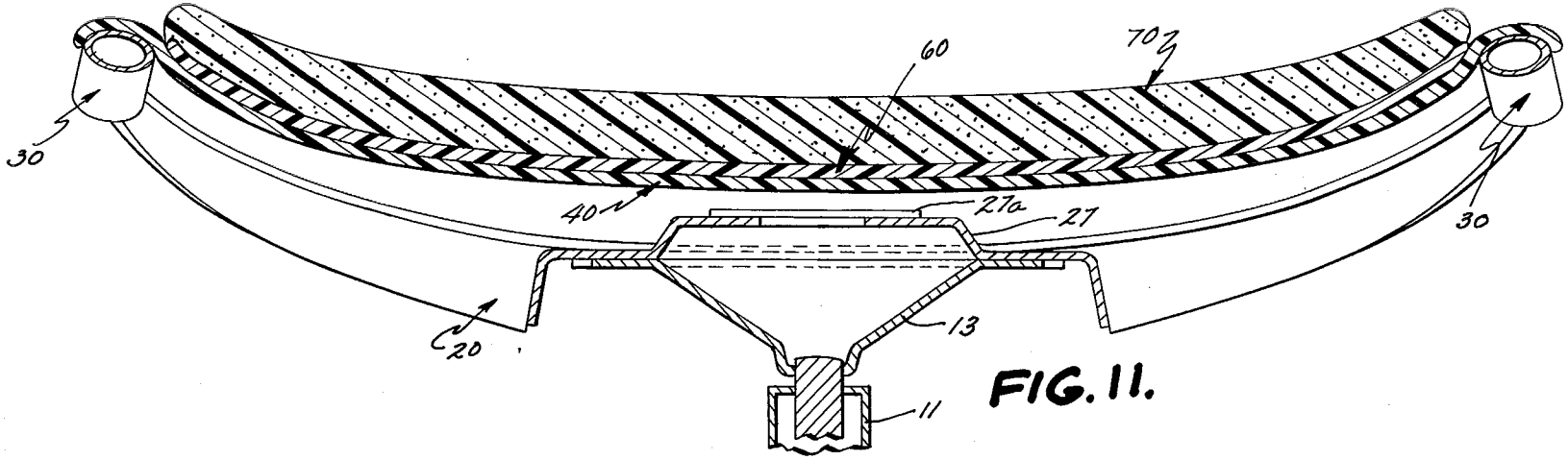
FIG. 11 is a cross-sectional view taken along plane XI—XI of FIG. 1.
Figure 12:
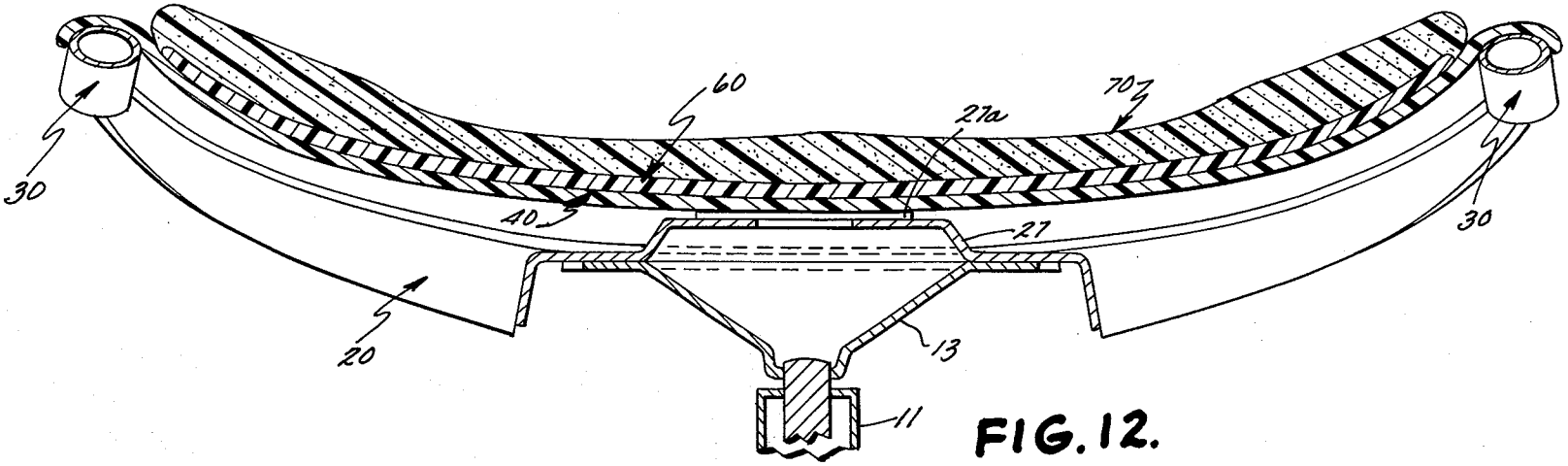
FIG. 12 is the same view as FIG. 11, but with a person seated in the chair.

The stretcher 20 also includes an upwardly protruding dome 27 generally in the center of mounting pan 21, above support column 11 of base 10, which leaves clearance space for the top of control 13 of base 10. More importantly, dome 27 provides a support surface for supporting seat 40. The distance between the bottom of supporting seat 40 and the top of dome 27 is about 5/16 inch (FIG. 11), or more specifically, ¼ inch to the steel itself and about ⅛ inch to the top of cushion tape 27*a*. It is a sufficiently small distance that when a person sits on the chair, supporting seat 40 comes to rest on the top of dome 27 before sufficient stress is put on channels 41 to cause them to unwrap from or, in other words, be pulled off of side rails 30 (FIG. 12). In essence, dome 27 serves as a support so that at least some of the load imposed on the chair is transmitted directly axially downwardly onto dome 27 and from thence to the column 11 of base 10. This diminishes the amount of stress which has to be carried by side rails 30. As a result, the need for extensive, complicated fastening between channels 41 and side rails 30 is minimized. Also, side rails 30 and the struts of stretcher 20 can be more economically manufactured. Yet, because there is a slight space between supporting seat 40 and seat supporting dome 27, seat 40 is allowed to give a little when sat upon, thereby giving the seat a yeilding, comfortable feeling to the user.

Adhered to the top surface of dome 27 are a pair of spaced, foam cushion tapes 27*a*. These comprise basically a cushiony material with a tape backing so that they can be taped directly to the top of dome 27. Cushion tapes 27*a* serve to deaden any "clunking" sound which might otherwise be created when the bottom of supporting seat 40 comes to rest on the top of dome 27.

The side rails 30 which are welded to the ends of struts 22 and 23 are tubular steel members bent to define a seat supporting portion 31 and a back supporting portion 32 (FIG. 2). They can be bent into any of a number of different configurations to give the chair a particular aesthetic or ornamental appearance.

Supporting seat 40 is formed by injection molding of a polypropylene copolymer (approximately 13% polethylene). Other plastics and other forming methods can be used. Seat 40 should be quite rigid, having a thickness of approximately 5/32 inch. Yet, it should have sufficient flexibility to allow it to give slightly when sat upon so that it feels comfortably yielding to the user. When supported on side rails 30, supporting seat 40 serves to support a person seated in the chair.

Figure 6:
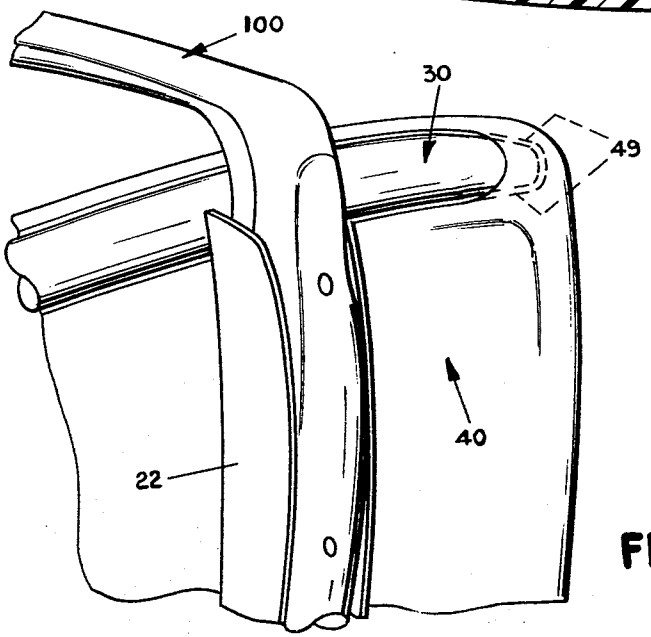
FIG. 6 is a fragmentary bottom view of the front left hand corner of the chair, that portion being indicated generally by the arrow VI on FIG. 4.

The channels 41 which are formed at each side of seat 40 are raised generally with respect to the rest of seat 40 so as to define a well 42 between the spaced channels 41 (FIG. 5) to receive an upholstered inner seat 60. Each channel 41 includes downwardly extending walls, the outer one of which wraps over the outside of its side rail 30. At the underside of seat 40, at each front corner of seat 40, each side channel 41 terminates in a recessed pocket 49 into which the forward end of side rail 30 extends (FIG. 6). This not only serves to hide the end of side rail 30, but also serves to secure supporting seat 40 in place at the front of the chair.

Figure 7:
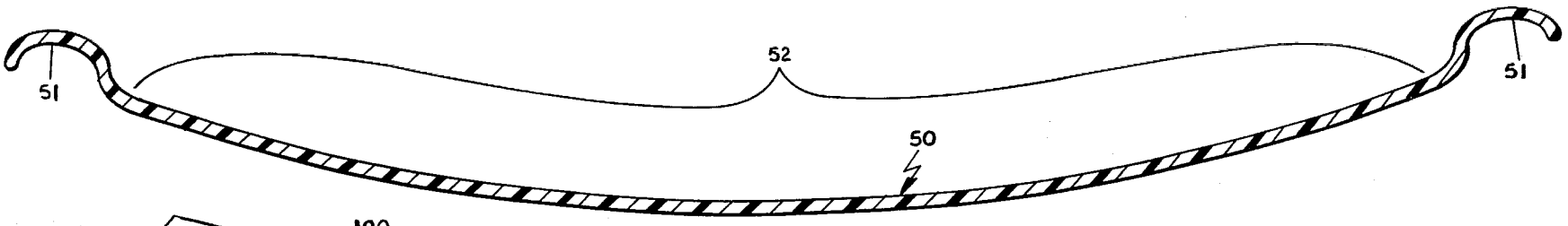
FIG. 7 is a cross-sectional view of the formed plastic back taken generally along plane VII—VII of FIG. 4.
Figure 8:
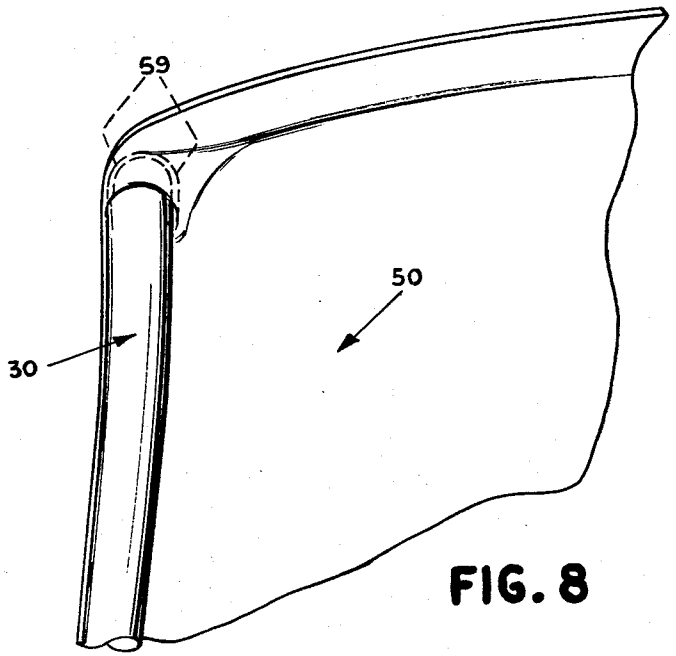
FIG. 8 is a fragmentary rear view of the upper left hand corner of the chair, that fragmentary portion being indicated generally by the arrow VIII shown on FIG. 4.

Back 50 is formed by injection molding of a polypropylene copolymer (approximately 13% polyethylene). Other plastics and other forming methods can be used. Back 50 should be quite rigid, having a thickness of approximately 5/32 inch. When supported on side rails 30, supporting back 50 serves to support a person leaning back in the chair. The channels 51 are formed at each side of back 50 so as to define a well 52 between the spaced channels 51 to receive an upholstered inner back 80 (FIG. 7). At the backside of back 50, at each top corner of back 50 into which the upper end of side rail 30 extends (FIG. 8). This not only serves to hide the end of side rail 30, but also serves to secure back 50 in place at the back of the chair.

Figure 4:
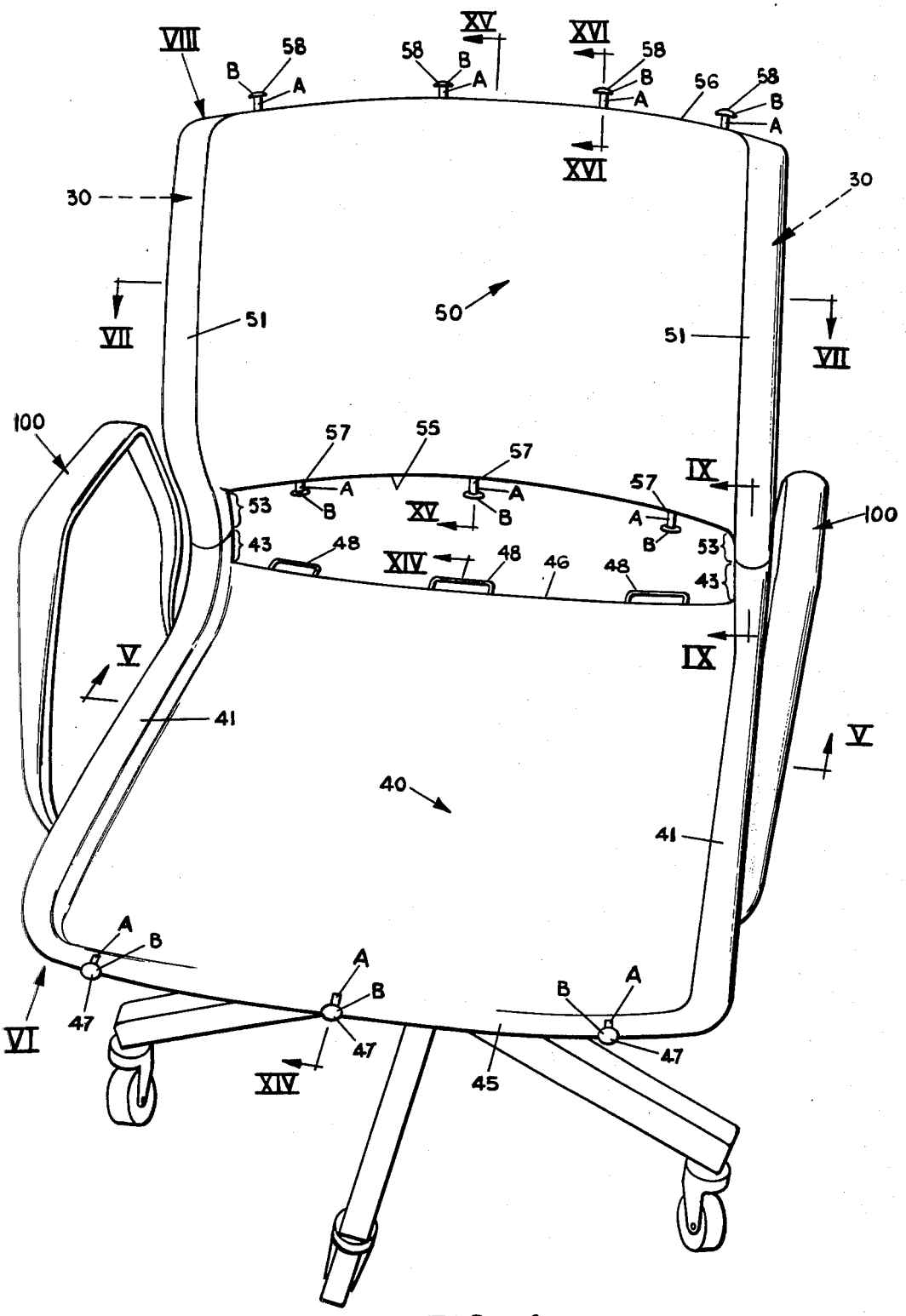
FIG. 4 is a perspective view of the chair before the inner seat and back have been attached.
Figure 5:
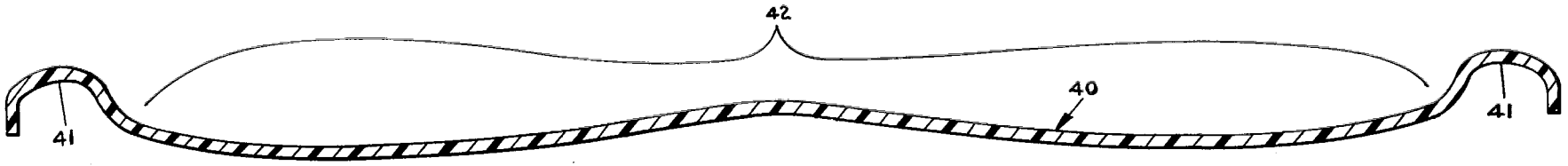
FIG. 5 is a cross-sectional view of the formed plastic seat taken generally along plane V—V of FIG. 4.
Figure 9:
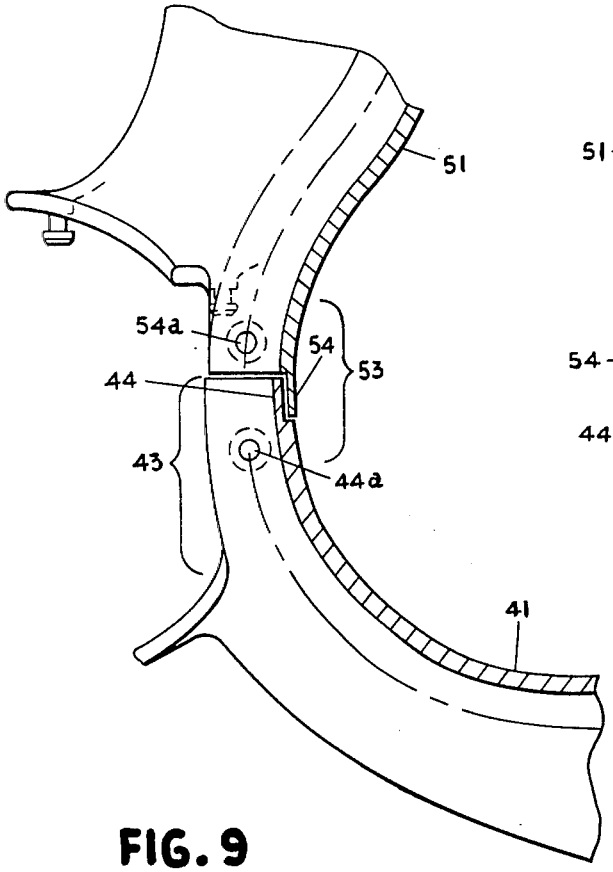
FIG. 9 is a fragmentary cross-sectional view of the overlapping portions of the formed plastic seat and backs taken generally along plane IX—IX of FIG. 4.
Figure 10:
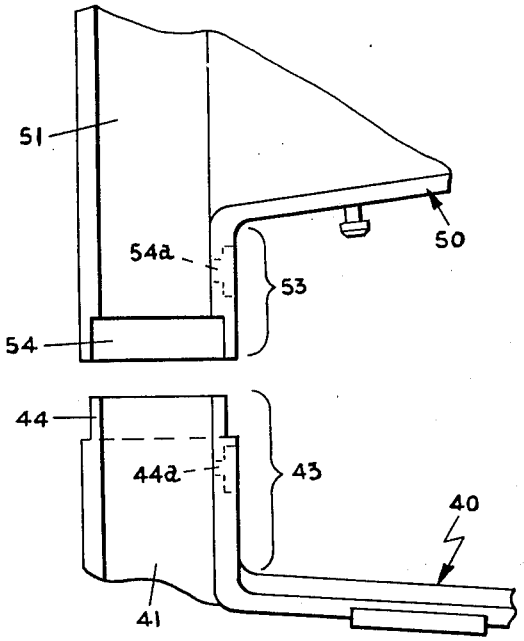
FIG. 10 is a fragmentary, rear view of the portions of the seat and back which are shown in FIG. 9, said portions being shown separated in FIG. 10.

The side channels 41 of seat 40 include projecting portions or seat channel projections 43 which project rearwardly and upwardly from the rear edge of seat 40 towards back 50 (FIGS. 4, 9, and 10). Similarly, the side channels 51 of back 50 include projecting portions or back channel projections 53 which project downwardly from the bottom of back 50 towards seat 40. Channel projection 43 terminates in a channel shaped flange 44 while channel projection 53 terminates in a channel shaped overlying flap 54. Flap 54 overlaps flange 44 so that the side channels 41 and 51 meet in such a way as to align channel projections 53 and 43 and to define a continuous, smooth flowing surface with only a slight line being visible at the junction. Once flap 54 is seated over flange 44, a screw is passed through a screw hole 54*a* in the inside of channel projection 53 (FIG. 9), above flap 54, and is threaded into underlying side rail 30. A similar screw is passed through screw hole 44*a* in the inside of channel projection 43 and is threaded into underlying side rail 30. This positively locks supporting seat 40 and supporting back 50 in place at their rear and bottom respectively so that once the ends of side rails 30 are in place in the pockets 49 and 59 of seat 40 and back 50 respectively and once the projecting side channel portions 43 and 53 are in their proper overlapping condition and secured by a screw through hole 54*a*, the back 50 and seat 40 are firmly secured to side rails 30.

Supporting seat 40 is covered by means of an inner seat 60 which itself is cushioned and upholstered with upholstery covering composite 70. The covered inner seat 60 is secured to supporting seat 40 by means of interengaging projections and apertures as is more fully described in copending patent application Ser. No. 463,191, invented by myself and Robert Clawson, filed on even date herewith, assigned to the assignee of the present application and incorporated herein by reference. The overall supporting seat and supporting back covering system is also more fully described in copending patent application Ser. No. 463,192, invented by Randall P. Buhk, filed on even date herewith, assigned to the assignee of the present application and incorporated herein by reference.

Similarly, supporting back 50 is covered by means of an inner back 80 which is itself covered by a suitable upholstery covering composite 90. This too is more fully described in the aforementioned two patent applications.

The arms 100 shown in the drawings are optional on the chair and also form no part of the present invention. Their manner of attachment to stretcher 20 is more fully described in the aforementioned patent application to Randall P. Buhk.

In operation, the chair of the present invention is both comfortable and strong. When seated upon, supporting seat 40 gives slightly to give the chair a yielding, comfortable feeling. Yet, it comes to rest on the top surface of dome 27 of stretcher 20 so that a portion of the weight imposed upon seat 40 is transmitted directly downwardly to dome 27 and from thence axially downwardly to support column 11 of base 10. The sound deadening strips of cushion tape 27*a* eliminate any possibility of a "clunking" noise as seat 40 comes to rest atop dome 27. As a result of this direct axial downward transmission of load, the entire stretcher assembly 20 and side rail assembly 30 can be more economically manufactured than if the entire load imposed on seat 40 had to be carried in a sling manner between side rails 30.

Of course, it is understood that the above is merely a preferred embodiment of the invention and that various changes and alterations can be made without departing from the spirit and broader aspects of the invention.

The embodiments of the invention in which an exclusive property or privilege is claimed are defined as follows:

1. A chair comprising: a base having a central, upwardly extending supporting column; a structural, load supporting stretcher operably mounted on said column, said stretcher including struts projecting outwardly towards each side of said chair; a pair of spaced side rails joined to said struts of said stretcher; a rigid supporting seat seated on said side rails and spanning the space therebetween, said seat having only sufficient flexibility to flex slightly when a person using the chair sits on it, thereby giving the chair a comfortably yielding feeling; means securing said supporting seat to both said side rails; a seat support surface on said stretcher positioned below said seat and generally above support column of said base, said seat support surface being operably connected to said seat support column and there being a slight space between said supporting seat and said seat support surface whereby said seat flexes downwardly slightly when a person sits on it and comes to rest on said seat support surface such that said seat support surface transmits a portion of the load imposed on said seat directly downwardly to said supporting column, thereby decreasing the load which has to be carried by said side rails and said struts of said stretcher; said seat support surface on said stretcher comprises the top surface of said stretcher; said stretcher includes an upwardly protruding dome, protruding upwardly towards the bottom of said supporting seat, the top of said dome defining said seat supporting surface; sound deadening material is placed on top of said seat support surface whereby when the bottom of said seat comes to rest on said seat support surface, said sound deadening material minimizes noise.

2. The chair of claim 1 in which said sound deadening material comprises a foam cushion material.

3. The chair of claim 2 in which said foam cushion material includes an adhering, tape surface whereby said sound deadening material is secured to said seat support surface by being taped thereto.

4. The chair of claim 3 in which said means securing said supporting seat to both said side rails includes a downwardly extending wall at each side thereof which wraps over the outside of the adjacent one of said side rails to aid in supporting said seat between said side rails.

5. The chair of claim 4 in which each of said downwardly extending walls at the side edges of said supporting seat comprise the exterior wall of channel located generally at each side of said supporting seat, said channel including an interior wall as well as said exterior wall, and said channel being seated over its respective one of said side rails with its exterior and interior wall embracing said side rail; each of said channels terminating in a pocket located generally at each front corner of said supporting seat, said pocket fitting over the end of its respective side rail.

6. The chair of claim 5 in which said supporting seat is secured to said side rails only by said channels being seated over said side rails, said side rails terminating in said pockets, and a fastener extending through said channel into said side rail generally at the rear corner of said supporting seat.

7. The chair of claim 6 in which said supporting seat includes a downwardly extending wall at each side thereof which wraps over the outside of the adjacent one of said side rails to aid in supporting said seat between said side rails.

8. The chair of claim 7 in which each of said downwardly extending walls at the side edges of said supporting seat comprise the exterior wall of a channel located generally at each side of said supporting seat, said channel including an interior wall as well as said exterior wall, and said channel being seated over its respective one of said side rails with its exterior and interior wall embracing said side rail; each of said channels terminating in a pocket located generally at each front corner of said supporting seat, said pocket fitting over the end of its respective side rail.

9. The chair of claim 8 in which said supporting seat is secured to said side rails only by said channels being seated over said side rails terminating in said pockets, and a fastener extending through said channel into said side rail generally at the rear corner of said supporting seat.

* * * * *